US010492658B2

(12) United States Patent
Yoo et al.

(10) Patent No.: US 10,492,658 B2
(45) Date of Patent: Dec. 3, 2019

(54) DISHWASHER

(71) Applicant: Samsung Electronics Co., Ltd., Suwon-si (KR)

(72) Inventors: Soo Hyung Yoo, Suwon-si (KR); Johannes Buesing, Yongin-si (KR); In Ju Lee, Yongin-si (KR); Chang Wook Lee, Seoul (KR); Seung Gee Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 71 days.

(21) Appl. No.: 15/692,348

(22) Filed: Aug. 31, 2017

(65) Prior Publication Data

US 2018/0055330 A1 Mar. 1, 2018

(30) Foreign Application Priority Data

Sep. 1, 2016 (KR) ..... 10-2016-0112811

(51) Int. Cl.

| | |
|---|---|
| ***A47L 15/18*** | (2006.01) |
| ***A47L 15/42*** | (2006.01) |
| ***A47L 15/23*** | (2006.01) |
| ***A47L 15/00*** | (2006.01) |

(52) U.S. Cl.

CPC ..... *A47L 15/23* (2013.01); *A47L 15/0002* (2013.01); *A47L 15/0018* (2013.01); *A47L 15/4206* (2013.01); *A47L 2601/16* (2013.01)

(58) Field of Classification Search

CPC ..... A47L 15/06; A47L 15/16; A47L 15/18; A47L 15/20; A47L 15/4219; A47L 15/4221; A47L 15/4246; A47L 15/4278; A47L 15/4282; A47L 2601/16

See application file for complete search history.

(56) References Cited

U.S. PATENT DOCUMENTS

2015/0129004 A1* 5/2015 Lee ..... A47L 15/4278 134/198

2015/0257623 A1 9/2015 Beshears, Jr. et al.

FOREIGN PATENT DOCUMENTS

| | | |
|---|---|---|
| JP | 2009-78659 | 4/2009 |
| KR | 1998-030117 | 8/1998 |
| KR | 10-2015-0079381 | 7/2015 |

* cited by examiner

*Primary Examiner* — David G Cormier

(74) *Attorney, Agent, or Firm* — Staas & Halsey LLP

(57) ABSTRACT

A dishwasher including a washing tub having a bottom plate having an opening, a nozzle having a spraying hole configured to spray water, the nozzle passing through the opening, and a sealing member configured to seal the opening. The bottom plate includes a base portion on which the nozzle is installed, and a protruding portion extending downward from the base portion to form the opening, the nozzle includes a support portion on the base portion, and a nozzle side portion facing the protruding portion. A part of the support portion contacts the base portion and another part of the support portion is spaced apart from the base portion according to an inclination of the base portion, where the sealing member is disposed between the protruding portion and the nozzle side portion. The spraying trajectory of the water can thus be kept constant despite the inclination deviation of the base portion.

18 Claims, 19 Drawing Sheets

DISHWASHER

CROSS-REFERENCE TO RELATED APPLICATION(S)

This application claims the benefit of Korean Patent Application No. 10-2016-0112811, filed on Sep. 1, 2016 in the Korean Intellectual Property Office, the disclosure of which is incorporated herein by reference.

BACKGROUND

1. Field

The present disclosure relates to a dishwasher, and more particularly, to an assembly structure of a nozzle for maintaining a constant spray angle of the nozzle with respect to a rail.

2. Description of the Related Art

A dishwasher includes a main body having a washing tub therein, a basket for storing dishware, a sump for storing washing water, a spray nozzle for spraying washing water, and a pump for supplying washing water stored in the sump to the spray nozzle. The dishwasher is a home appliance that cleans dishware by spraying washing water of high pressure onto the dishware.

The dishwasher is classified into a rotor type and a linear type. The rotor type has a rotating spray nozzle, and the linear type has a fixed spray nozzle fixed at one side of the washing tub, and a reflecting plate moving in the washing tub to reflect washing water sprayed from the fixed spray nozzle toward dishware to thereby spray washing water to the entire space of the washing tub.

In a linear type dishwasher, alignment between a rail for guiding a movement of the reflecting plate and the nozzle for spraying washing water is important in order to make washing water sprayed from the fixed nozzle arrive at the reflecting plate stably.

In general, since the fixed nozzle is installed on the bottom plate of the washing tub, the spray angle of the fixed nozzle may change if the bottom plate is inclined.

SUMMARY

One aspect of the present disclosure discloses a dishwasher capable of maintaining a constant spray angle of a fixed nozzle with respect to a rail even if a bottom plate on which the fixed nozzle is installed is inclined.

Another aspect of the present disclosure discloses a dishwasher capable of stably sealing an opening of a bottom plate through which a nozzle passes in solving the above problem.

In accordance with one aspect of the present disclosure, a dishwasher includes a washing tub having a bottom plate having an opening; a nozzle having a spraying hole configured to spray washing water, the nozzle passing through the opening; and a sealing member configured to seal the opening, the bottom plate includes a base portion on which the nozzle is installed, and a protruding portion extending downward from the base portion to form the opening, the nozzle includes a support portion supported on the base portion, and a nozzle side portion facing the protruding portion, wherein the support portion is configured such that a part of the support portion contacts the base portion and the other part of the support portion is spaced apart from the base portion according to an inclination of the base portion, and the sealing member is disposed between the protruding portion and the nozzle side portion.

The support portion may extend along a rim of the opening around the opening.

A lower surface of the support portion may be inclined.

A lower surface of the support portion may comprise: a hinge portion protruding to a downmost position; a front inclined portion extending in a front direction from the hinge portion; and a rear inclined portion extending in a rear direction from the hinge portion.

If the base portion is not inclined, the hinge portion may contact the base portion, and the front inclined portion and the rear inclined portion may be spaced apart from the base portion.

If the base portion is inclined downward from the front to the rear, the front inclined portion may contact the base portion, and the rear inclined portion may be spaced apart from the base portion.

If the base portion is inclined upward from the front to the rear, the rear inclined portion may contact the base portion, and the front inclined portion may be spaced apart from the base portion.

A plurality of hinge portions may be formed in left and right areas of the support portion in such a way to be symmetrical to each other.

The nozzle may include a sealing member mounting portion formed on the nozzle side portion and configured to mount the sealing member thereon.

A thickness of the sealing member may be equal to or greater than a sum of a thickness of the protruding portion and a maximum allowable gap between the support portion and the base portion.

The sealing member may include an O-ring having a circular cross section.

The dishwasher may further comprise: a reflecting plate configured to reflect the washing water sprayed from the nozzle; and a rail configured to guide a movement of the reflecting plate, wherein the nozzle may be coupled with the rail.

The rail may include a reference plane for alignment of the rail and the nozzle, and the nozzle includes a seating plane being in close contact with the reference plane, and the rail may be coupled with the nozzle such that the reference plane is in close contact with the seating plane.

A dishwasher may comprise a washing tub having a bottom plate; and a nozzle having a spraying hole configured to spray washing water, wherein the bottom plate may include a base portion on which the nozzle is installed, the nozzle may include a support portion configured to support the nozzle on the base portion, while compensating for an inclination of the base portion, and a lower surface of the support portion comprises: a hinge portion protruding to a downmost position; a front inclined portion extending in a front direction from the hinge portion; and a rear inclined portion extending in a rear direction from the hinge portion.

An opening may be formed in the bottom plate, and the nozzle may pass through the opening.

The dishwasher may further comprise a sealing member configured to seal the opening.

The bottom plate may include a protruding portion extending downward from the base portion to form the opening, the nozzle may include a nozzle side portion facing the protruding portion, and the sealing member may seal between the protruding portion and the nozzle side portion.

In accordance with anther aspect of the present disclosure, a dishwasher comprise a washing tub having a bottom plate;

a nozzle having a spraying hole configured to spray washing water; a reflecting plate configured to reflect the washing water sprayed from the nozzle; and a rail configured to guide a movement of the reflecting plate, wherein the bottom plate includes a base portion on which the nozzle is installed, and the nozzle is coupled with the rail such that there is no inclination between the nozzle and the rail regardless of an inclination of the base portion.

The rail may include a reference plane for alignment with the nozzle, the nozzle may include a seating plane being in close contact with the reference plane, and the rail may be coupled with the nozzle such that the reference plane is in close contact with the seating plane.

The nozzle may include a support portion configured to support the nozzle on the base portion, while compensating for the inclination of the base portion.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

The embodiments described herein are merely the most preferred embodiments of the present disclosure and are not intended to represent all of the technical ideas of the present disclosure, so it should be understood that various equivalents or modifications that may be substituted for the same at the time of filing of the application are also included in the scope of the present disclosure.

Hereinafter, preferred embodiments of the present disclosure will be described in detail with reference to the accompanying drawings. Hereinafter, front, rear, left and right directions will be defined as directions indicated by arrows shown in FIG. 2.

Figure 1:
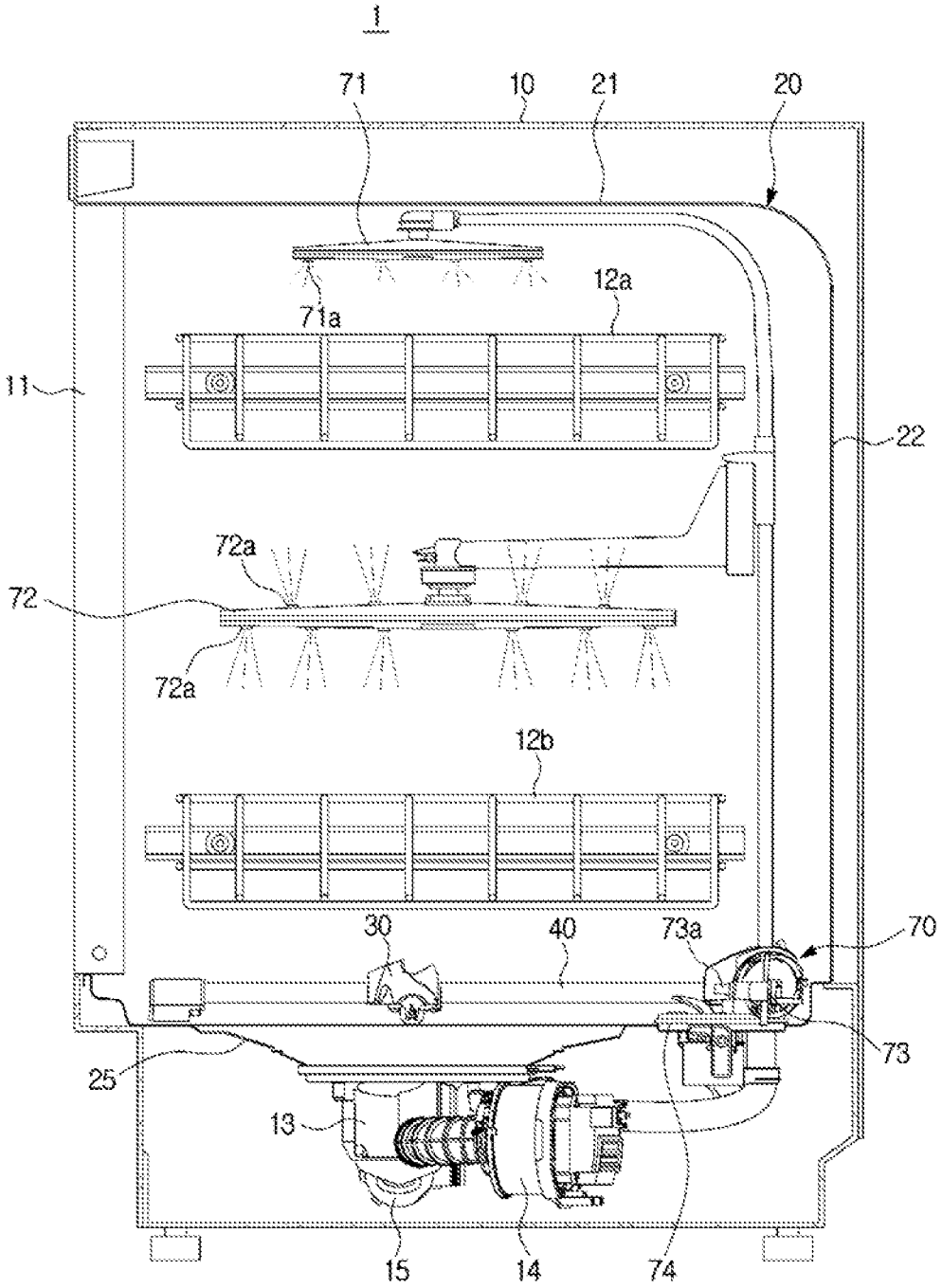
FIG. 1 is a side cross-sectional view schematically showing a main configuration of a dishwasher according to an embodiment of the present disclosure.
Figure 2:
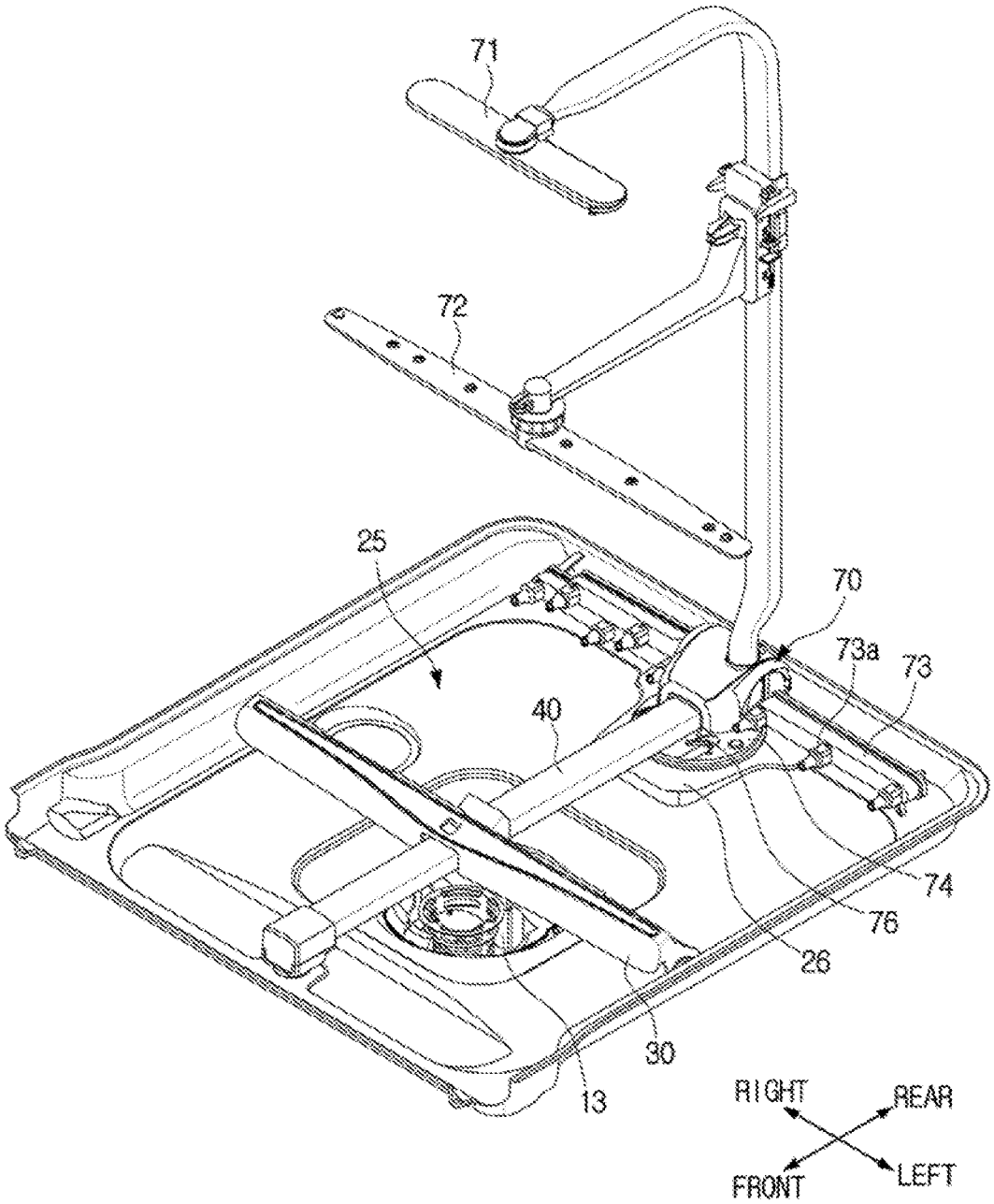
FIG. 2 is a perspective view showing a coupling structure of a nozzle, a rail, and a bottom plate of the dishwasher of FIG. 1.
Figure 3:
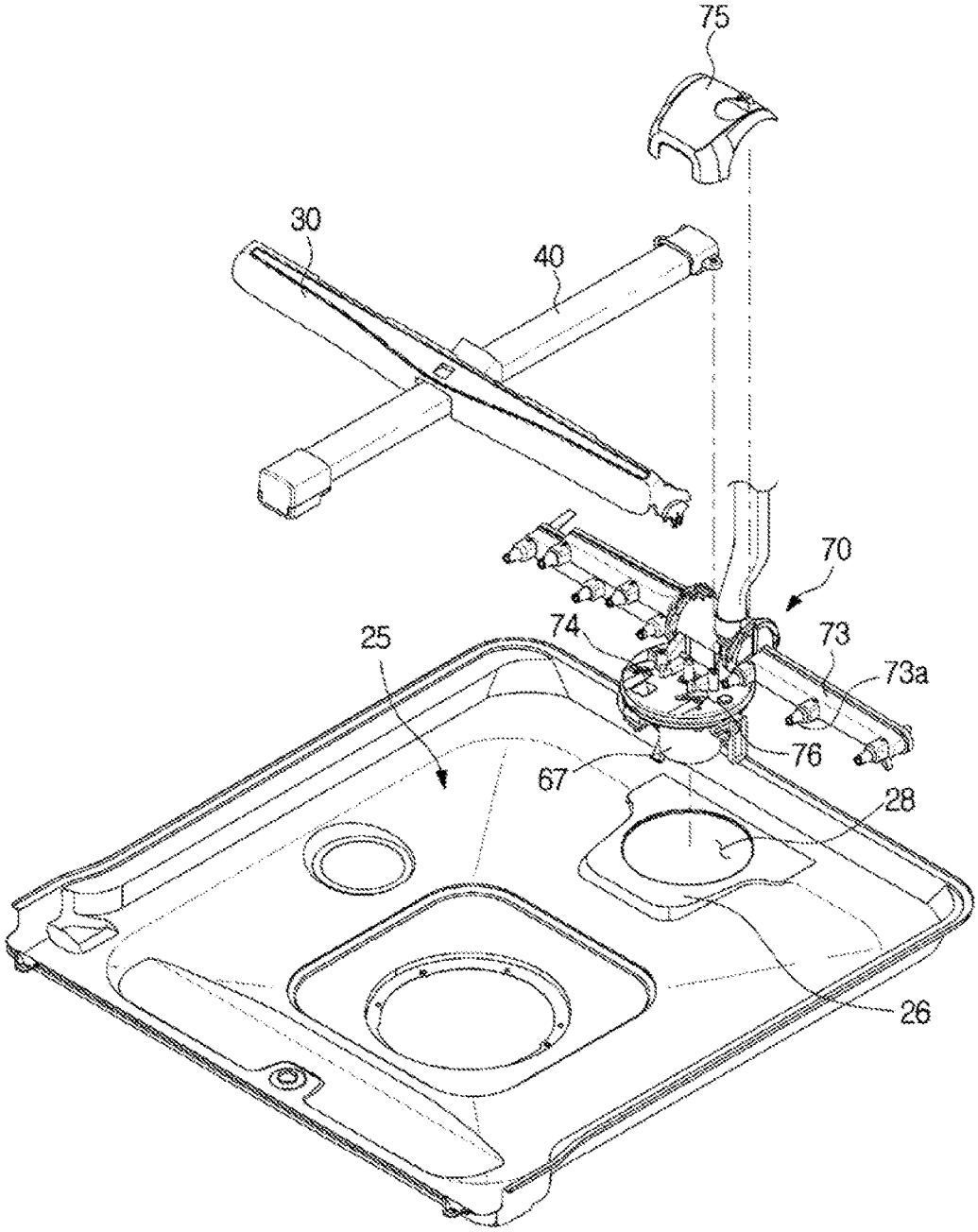
FIG. 3 is an exploded perspective view showing the nozzle, the rail, and the bottom plate of the dishwasher shown in FIG. 1 separated.
Figure 4:
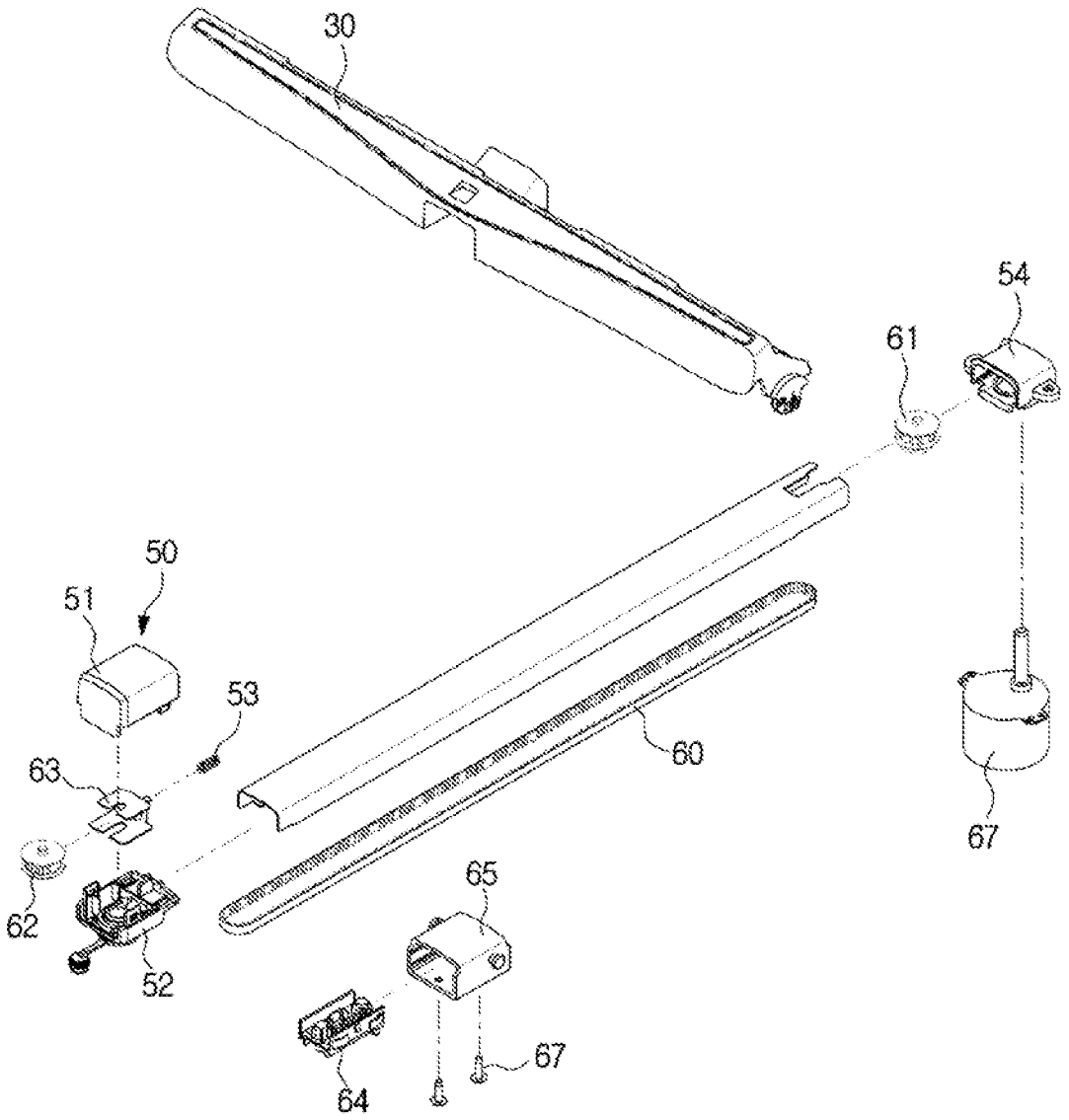
FIG. 4 is an exploded perspective view showing a rail assembly of the dishwasher of FIG. 1.
Figure 5:
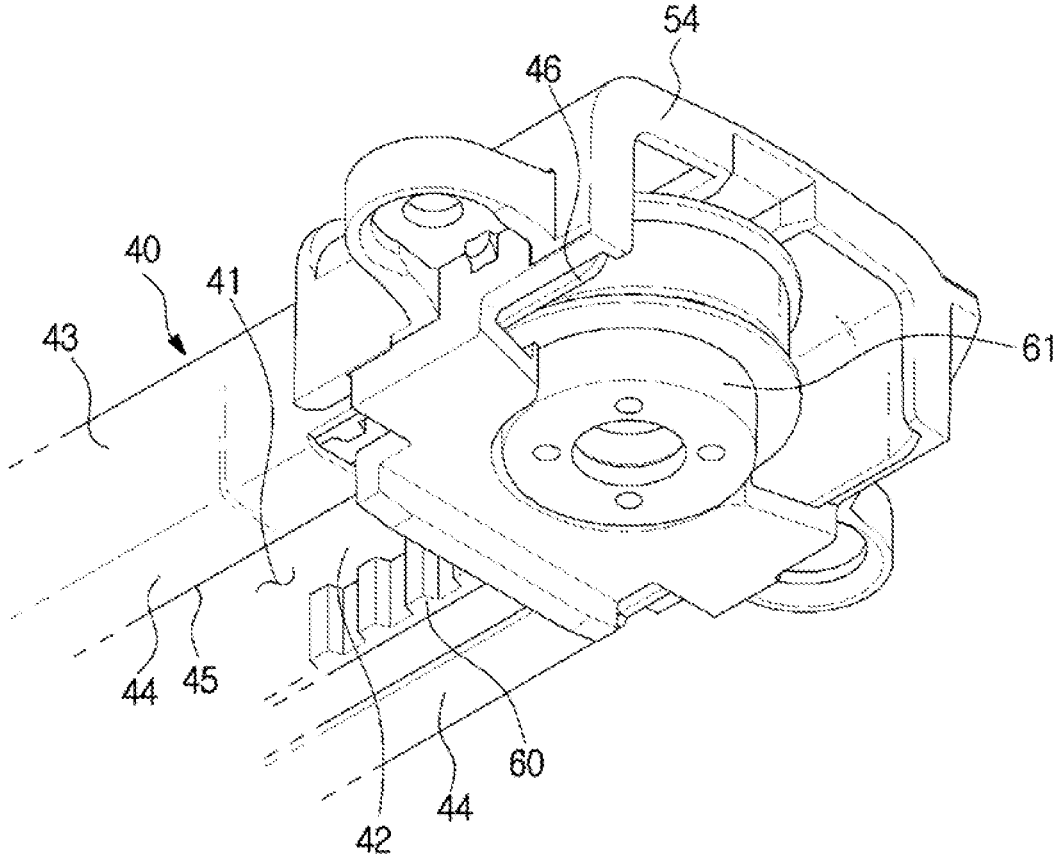
FIG. 5 is a bottom perspective view showing a rear end portion of the rail of the dishwasher of FIG. 1.
Figure 6:
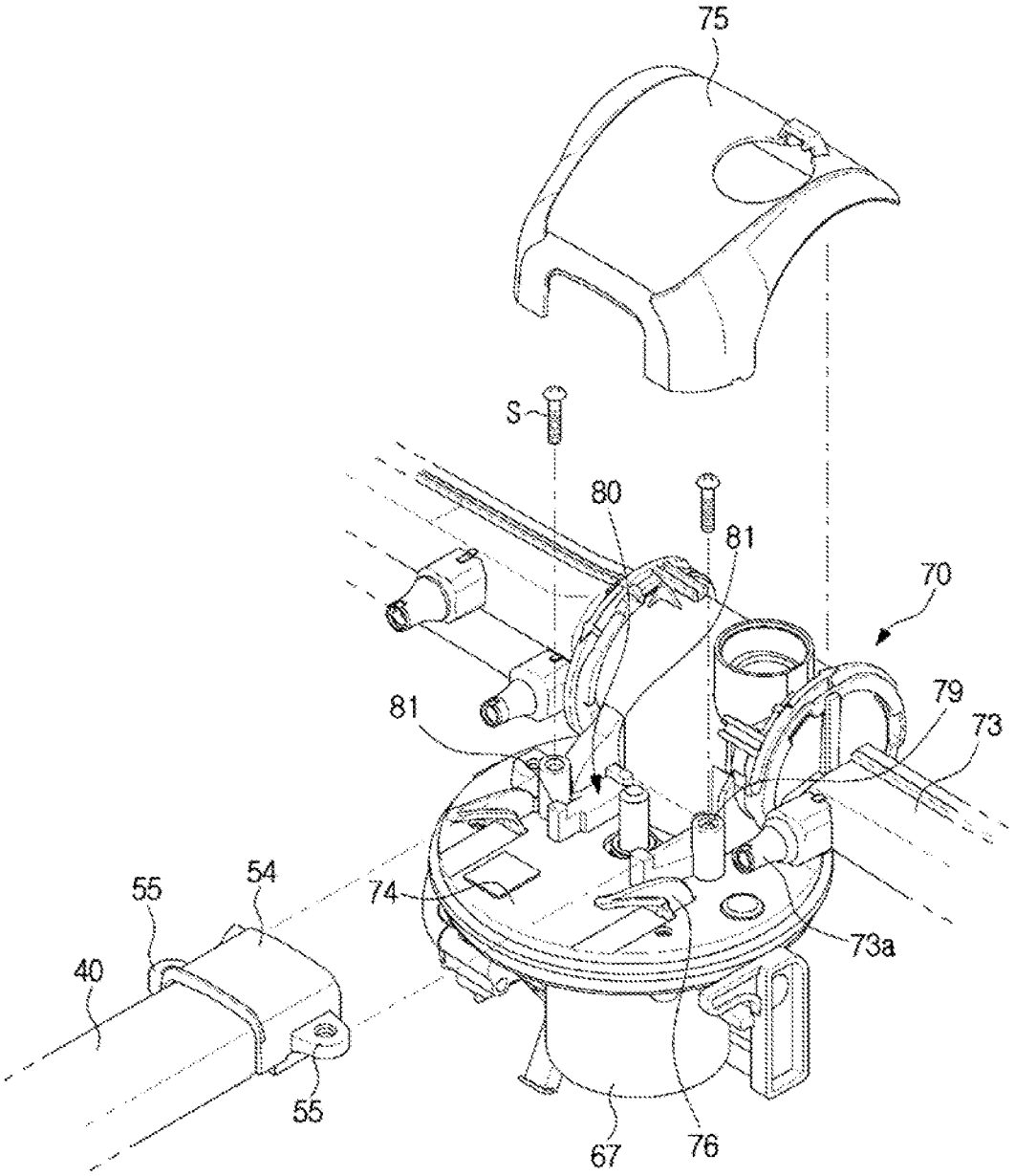
FIG. 6 is a perspective view showing a coupling structure of the rail and the nozzle of the dish washer shown in FIG. 1.

FIG. 1 is a side cross-sectional view schematically showing a main configuration of a dishwasher according to an embodiment of the present disclosure. FIG. 2 is a perspective view showing a coupling structure of a nozzle, a rail, and a bottom plate of the dishwasher of FIG. 1. FIG. 3 is an exploded perspective view showing the nozzle, the rail, and the bottom plate of the dishwasher shown in FIG. 1 separated. FIG. 4 is an exploded perspective view showing a rail assembly of the dishwasher of FIG. 1. FIG. 5 is a bottom perspective view showing a rear end portion of the rail of the dishwasher of FIG. 1. FIG. 6 is a perspective view showing a coupling structure of the rail and the nozzle of the dish washer shown in FIG. 1.

Referring to FIGS. 1 to 6, a dishwasher 1 may include a main body 10 forming an outer appearance of the dishwasher 1, a washing tub 20 disposed in the main body 10, baskets 12*a* and 12*b* disposed in the washing tub 20 to store dishes, a nozzle 70 to spray washing water, a sump 13 to store washing water, a circulation pump 14 to pump washing water stored in the sump 13 and to supply the washing water to the nozzle 70, a drain pump 15 to discharge washing water stored in the sump 13, together with filth, to the outside of the main body 10, a reflecting plate 30 moving in the inside of the washing tub 30 to reflect washing water toward the dishes, and a rail 40 to guide a movement of the reflecting plate 30.

The washing tub 20 may be in the shape of a substantially box having a front opening to allow a user to put or take dishes. The front opening of the washing tub 20 may be opened and closed by a door 11. The washing tub 20 may have a top wall 21, a rear wall 22, a left wall, a right wall, and a bottom plate 25.

The bottom plate 25 may include a base portion 26 on which the nozzle 70 is installed. In the current embodiment, the base portion 26 may protrude upward from the other portion of the bottom plate 25, although not limited thereto. However, the base portion 26 may not protrude from the other portion of the bottom plate 25. The base portion 26 may be a part of the bottom plate 25 on which the nozzle 70 is installed.

The nozzle 70 may be installed on the base portion 26, and the base portion 26 may support the load of the nozzle 70. The base portion 26 may define the inside space of the washing tub 20.

In the base portion 26, an opening 28 through which the nozzle 70 passes may be formed. The nozzle 70 may include a nozzle passage for connecting spraying portions 71, 72 and 73 disposed above the bottom plate 25 to the sump 13 disposed below the bottom plate 25. Therefore, the nozzle 70 may be installed on the base portion 26 so as to pass through the opening 28.

The baskets 12*a* and 12*b* may be racks made of wires through which washing water can pass without being collected. The baskets 12*a* and 12*b* may be detachably installed inside the washing tub 20. The baskets 12*a* and 12*b* may include an upper basket 12*a* disposed in the upper space of the washing tub 20 and a lower basket 12*b* disposed in the lower space of the washing tub 20.

The nozzle 70 can spray washing water at high pressure to clean dishes. The nozzle 70 may include an upper rotary spraying portion 71 disposed in the upper space of the washing tub 20, a middle rotary spraying portion 72 disposed in the middle space of the washing tub 20, and a lower fixed spraying portion 73 disposed in the lower space of the washing tub 20.

The upper rotary spraying portion 71 may be disposed above the upper basket 12*a* to spray washing water downward while rotating by water pressure. For this purpose, a spraying hole 71*a* may be formed in the lower part of the upper rotary spraying portion 71.

The middle rotary spraying portion 72 may be disposed between the upper basket 12*a* and the lower basket 12*b* to spray washing water in a vertical direction while rotating by water pressure. For this purpose, spraying holes 72*a* may be formed in the upper and lower parts of the middle rotary spraying portion 72.

The upper rotary spraying portion 71 and the middle rotary spraying portion 72 can spray washing water directly onto the stored dishes.

Unlike the rotary spraying portions 71 and 72, the lower fixed spraying portion 73 may be fixed at one side of the washing tub 20 so as not to move. The lower fixed spraying portion 73 may be disposed adjacent to the rear wall 22 of the washing tub 20 so as to spray washing water toward the front of the washing tub 20. The lower fixed spraying portion 73 may have a plurality of spraying holes 73*a* arranged in a left-right direction of the washing tub 20.

The reflecting plate 30 can extend in the left and right direction of the washing tub 20 so as to reflect all washing water sprayed from the plurality of spraying holes 73*a* of the lower fixed spraying portion 73. That is, one end in longitudinal direction of the reflecting plate 30 may be adjacent to the left wall of the washing tub 20, and the other end in longitudinal direction of the reflecting plate 30 may be adjacent to the right wall of the washing tub 20.

The reflecting plate 30 can reciprocate linearly along a spraying direction of washing water sprayed from the lower fixed spraying portion 73. In other words, the reflecting plate 30 can linearly reciprocate in a front-back direction of the washing tub 20.

The dishwasher 1 may include a distributing apparatus to distribute washing water stored in the sump 13 to the upper rotary spraying portion 71, the middle rotary spraying portion 72, and the lower fixed spraying portion 73.

The nozzle 70 may include a nozzle body 74 for supporting the spraying portions 71, 72 and 73 and having a nozzle passage for guiding washing water to the spraying portions 71, 72 and 73, respectively. The nozzle body 74 may include a rotation guide 76 for guiding a rotation of the reflecting plate 30 when the reflecting plate 30 approaches the nozzle 70 to be located at a predetermined distance from the nozzle 70. The nozzle 70 may include a nozzle cover 75 detachably coupled to the nozzle body 74 to cover the top of the nozzle body 74.

The dishwasher 1 may include a driving apparatus for providing a driving force for a linear reciprocating movement of the reflecting plate 30. The driving apparatus may include a motor 67 for generating a driving force, and a rail assembly.

The rail assembly may include a rail 40 for guiding a movement of the reflecting plate 30, a drive pulley 61 connected to the motor 67 to rotate, a belt 60 connected to the drive pulley 61 to rotate, an idle pulley 62 connected to the belt 60 to rotatably support the belt 60, a belt holder 64 engaged with the belt 60 to be disposed on the rail 40 to linearly reciprocate, a reflecting holder 65 coupled to the belt holder 64 and disposed outside the rail 40 to linearly reciprocate and coupled to the reflecting plate 30, a rear holder 54 configured to rotatably support the driving pulley 61 and coupled to the rear end of the rail 40, and a front holder 50 configured to rotatably support the idle pulley 52 and coupled to the front end of the rail 40.

The rail 40 may be formed of a metal material. The rail 40 may have a tubular shape with an opening 45 formed at a substantially lower portion thereof. That is, the rail 40 may include inner space 41, a top wall 42, a bottom wall 44, both side walls 43, and the opening 45 formed in the bottom wall 44.

The belt 60 may be wound around the driving pulley 61 and the idle pulley 62 to form a closed loop, and when the motor 67 is driven, the belt 60 can rotate in the rotating direction of the motor 67. The belt 60 may be formed of a resin material containing aramid fibers in consideration of tensile strength and cost.

The reflecting holder 65 may be coupled to the belt holder 64, and move together with the belt holder 64 to transmit a driving force to the reflecting plate 30. The reflector holder 65 may surround the outer surface of the rail 40, and can be coupled to the belt holder 64 through the lower opening 45 of the rail 40. The reflecting plate holder 65 and the belt holder 64 can be firmly coupled by the fastening member 67.

The rear holder 54 may rotatably support the drive pulley 61, and may be coupled to the rear end of the rail 40.

The front holder 50 may include a front top holder 51, a front bottom holder 52 coupled to a lower portion of the front top holder 51, and a pulley bracket 63 disposed between the front top holder 51 and the front bottom holder 52 to be movable along the longitudinal direction of the rail 40 and to rotatably support the idle pulley 62.

The rail 40, the belt 60, the drive pulley 61, the rear holder 54, the idle pulley 62, and the front holder 50 (that is, the rail assembly) can be assembled together by the tension of the belt 60. The front holder 50 may have an elastic member 53 for holding the tension of the belt 60.

The front end of the rail assembly may be coupled to the bottom plate 25 of the washing tub 20, and the rear end of the rail assembly may be coupled to the nozzle 70. That is, the front holder 50 may be coupled to the bottom plate 25 of the washing tub 20, and the rear holder 54 can be coupled to the nozzle 70.

The rear holder 54 and the nozzle 70 may be provided with fastening holes 55 and 79 (FIG. 6) for coupling the rear holder 54 with the nozzle 70, respectively. The rear holder 54 and the nozzle 70 can be coupled by fastening separate fastening members S to the fastening holes 55 and 79.

When the rear holder 54 is engaged with the nozzle 70, the rail 40 may be coupled with the nozzle 70. To this end, the rail 40 may have a reference plane 46 (FIG. 5) for aligning with the nozzle 70, and the nozzle 70 may have a seating plane 81 (FIG. 6) to closely contact the reference plane 46.

The seating plane 81 may be formed on the top end of the seating portion 80 protruding from the nozzle body 74.

The reference plane 46 and the resting plane 81 may be vertical to an insertion direction of the fastening members S that are coupled to the fastening holes 55 and 79. That is, when the fastening members S are inserted into the coupling holes 55 and 79 to couple the rear holder 54 with the nozzle 70, the reference plane 46 of the rail 40 may closely contact the seating plane 81 of the nozzle 70 so that the rail 40 can be coupled with the nozzle 70.

Since the rail 40 is coupled with the nozzle 70 in this way, an angle formed between the rail 40 and a spraying direction of washing water sprayed from the nozzle 70 can be maintained constant regardless of the inclination of the bottom plate 25 on which the nozzle 70 is installed.

The above-described structure according to the current embodiment of the present disclosure in which the rail 40 closely contacts the nozzle 70 may have an effect of reducing an angular deviation between the rail 40 and the nozzle 70, compared to an indirect coupling structure in which the rail 40 first closely contacts the rear holder 54 and the rear holder 54 secondarily closely contacts the nozzle 70.

Figure 7:
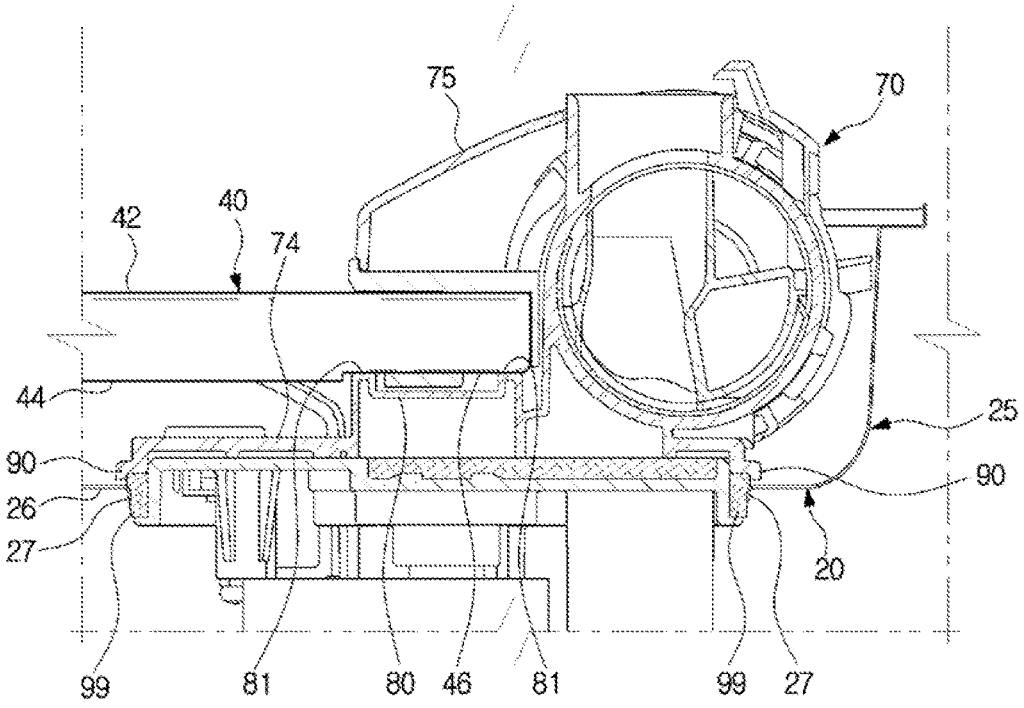
FIG. 7 is a side cross-sectional view showing a coupling structure of the rail and the nozzle of the dish washer of FIG. 1.
Figure 8:
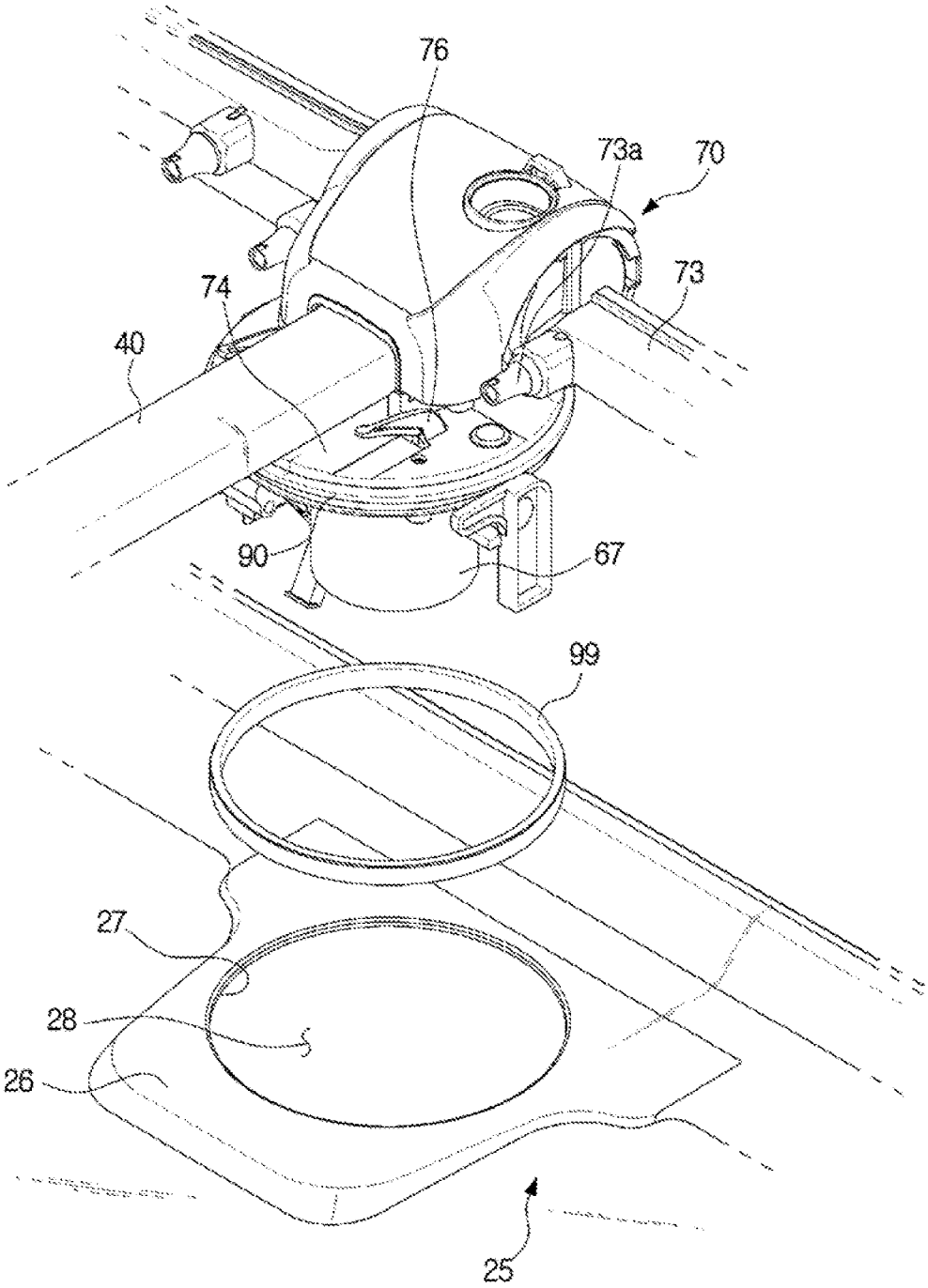
FIG. 8 is an exploded perspective view showing the nozzle, a sealing member, and the bottom plate of the dishwasher shown in FIG. 1.
Figure 9:
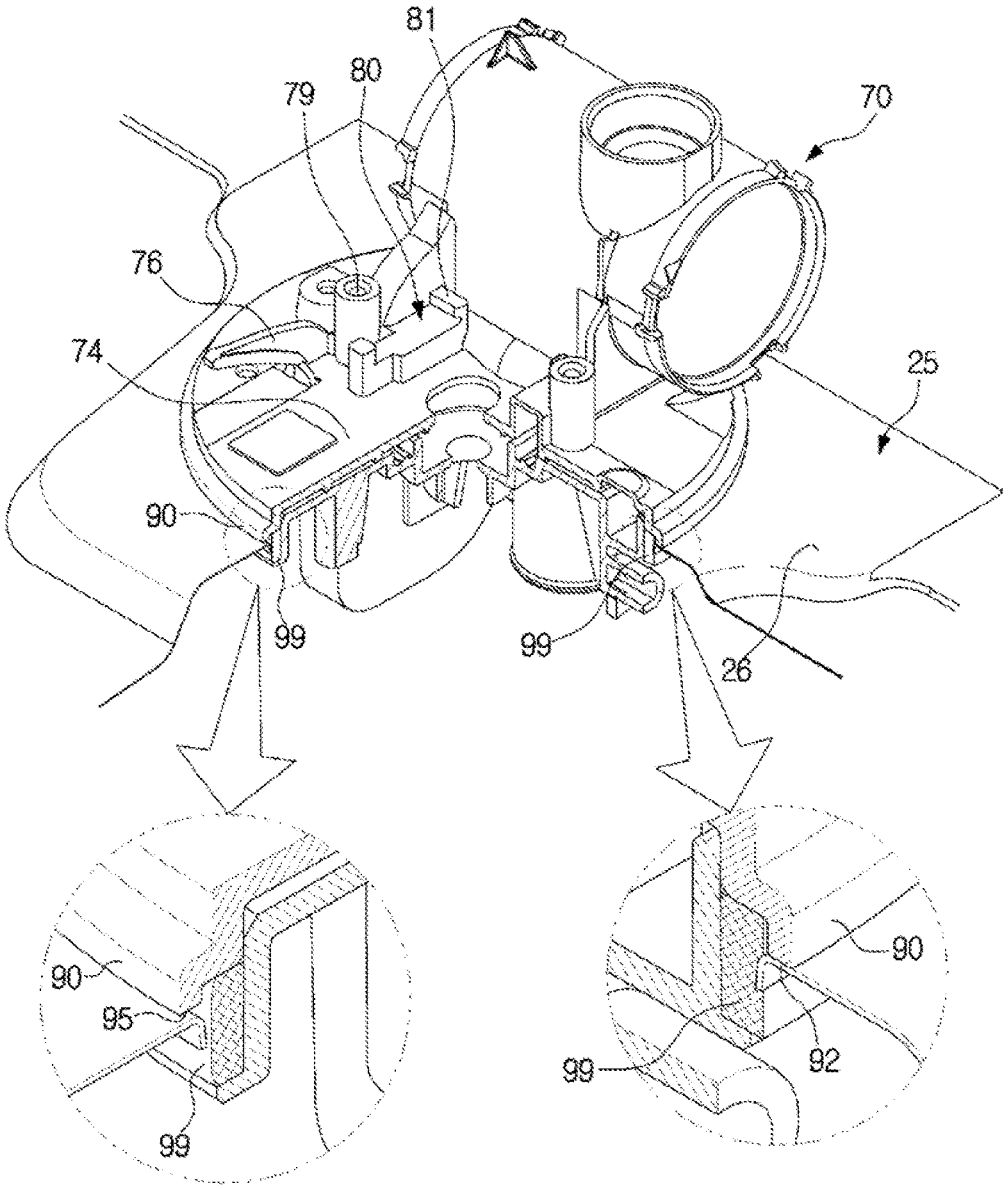
FIG. 9 is a perspective partially cross-sectional view showing a structure of a support portion of the dishwasher of FIG. 1.
Figure 10:
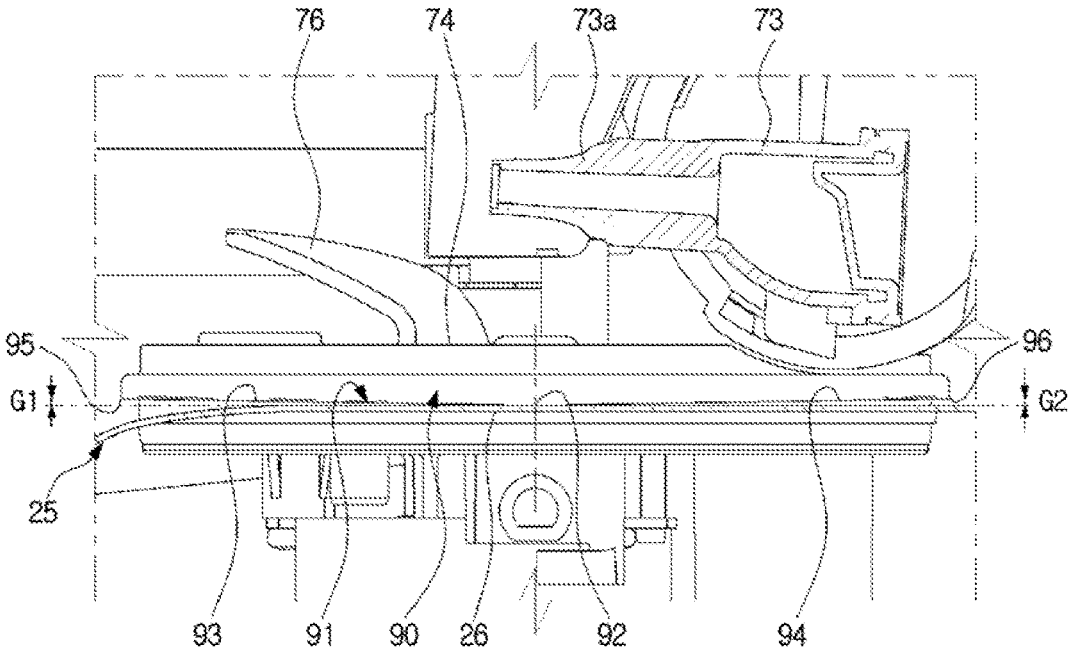
FIG. 10 is a side view showing a structure in which a part of the support portion of the dishwasher of FIG. 1 is in contact with the base portion and the other part of the support portion is spaced apart from the base portion.
Figure 11:
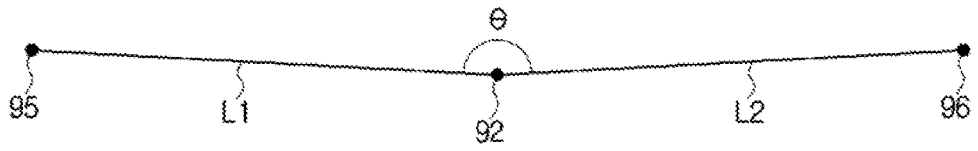
FIG. 11 is a view schematically showing an inclined structure of the bottom surface of the support portion of the dishwasher of FIG. 1.
Figure 12:
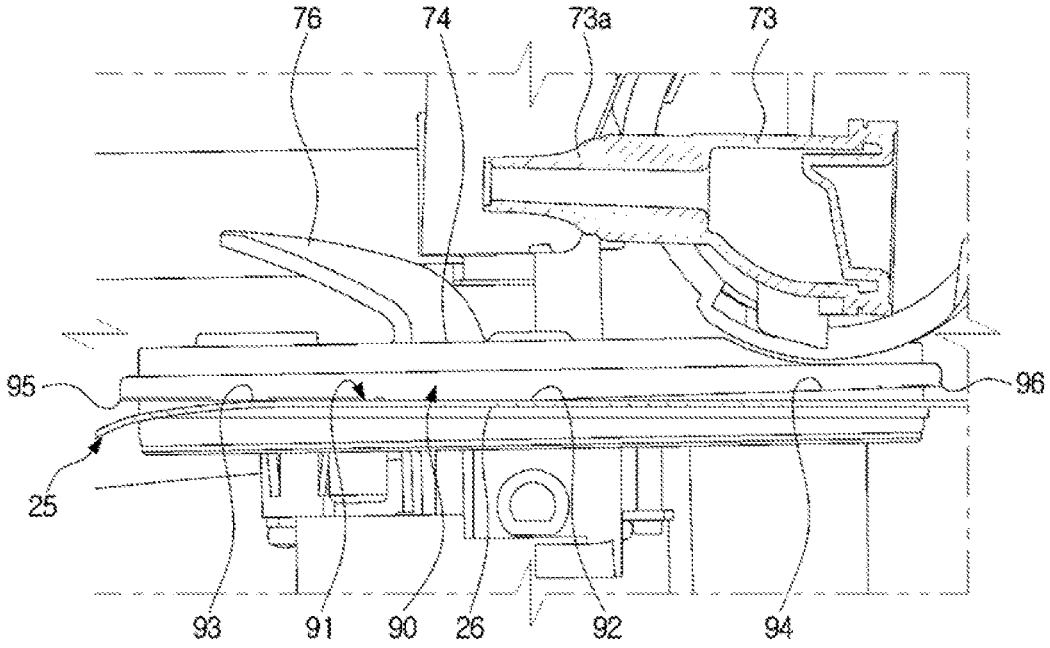
FIG. 12 is a side view showing a positional relationship between the support portion and the base portion in the case where the base portion of the dishwasher of FIG. 1 is inclined downward from the front to the rear.
Figure 13:
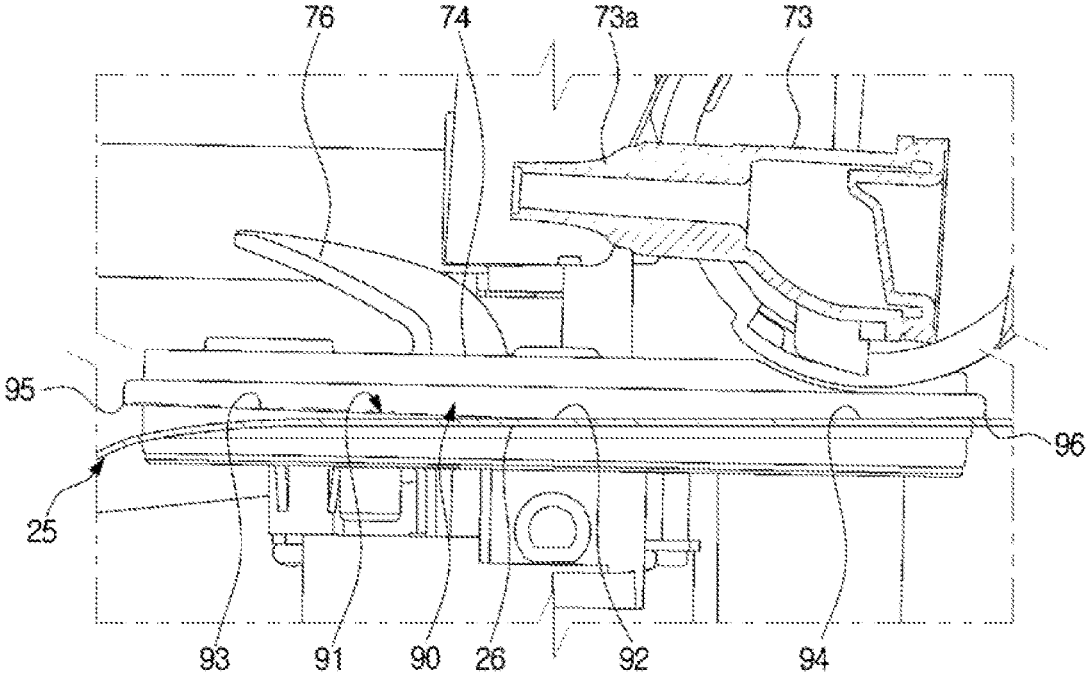
FIG. 13 is a side view showing a positional relationship between the support portion and the base portion in the case where the base portion of the dishwasher of FIG. 1 is inclined upward from the front to the rear.
Figure 14:
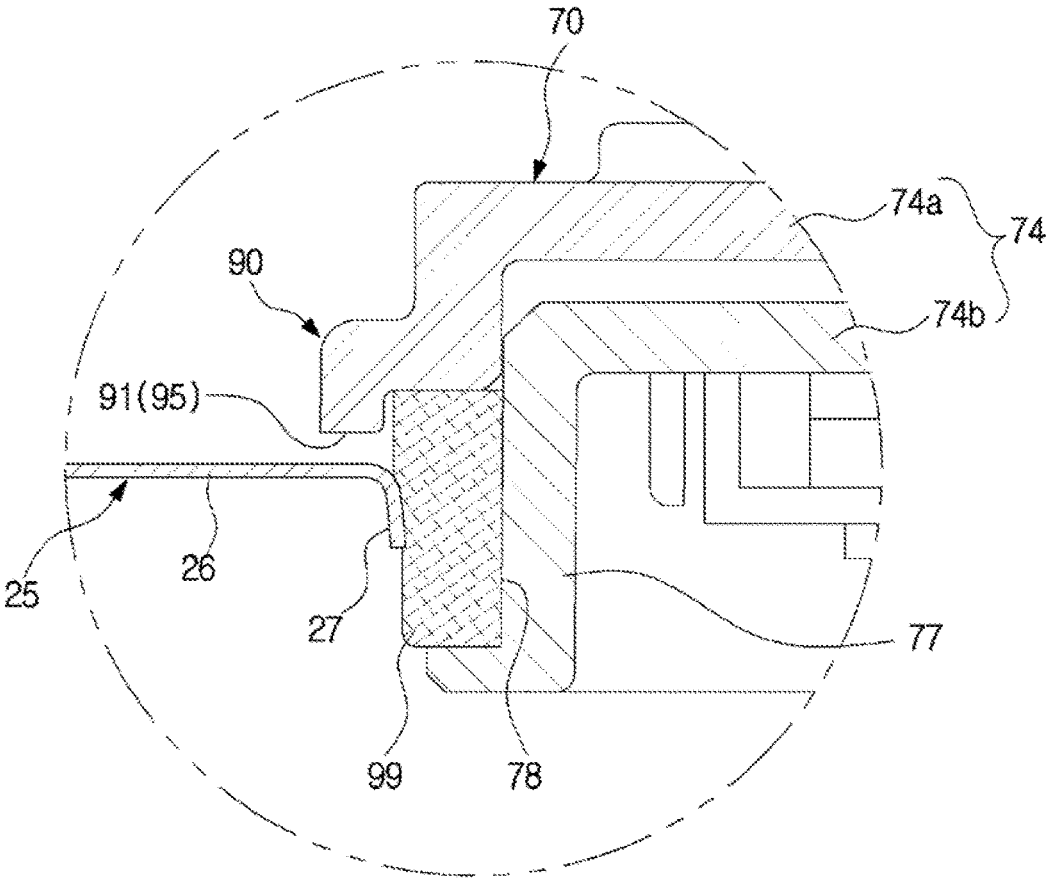
FIG. 14 is an enlarged cross-sectional view of a front end portion of the support portion shown in FIG. 11.
Figure 15:
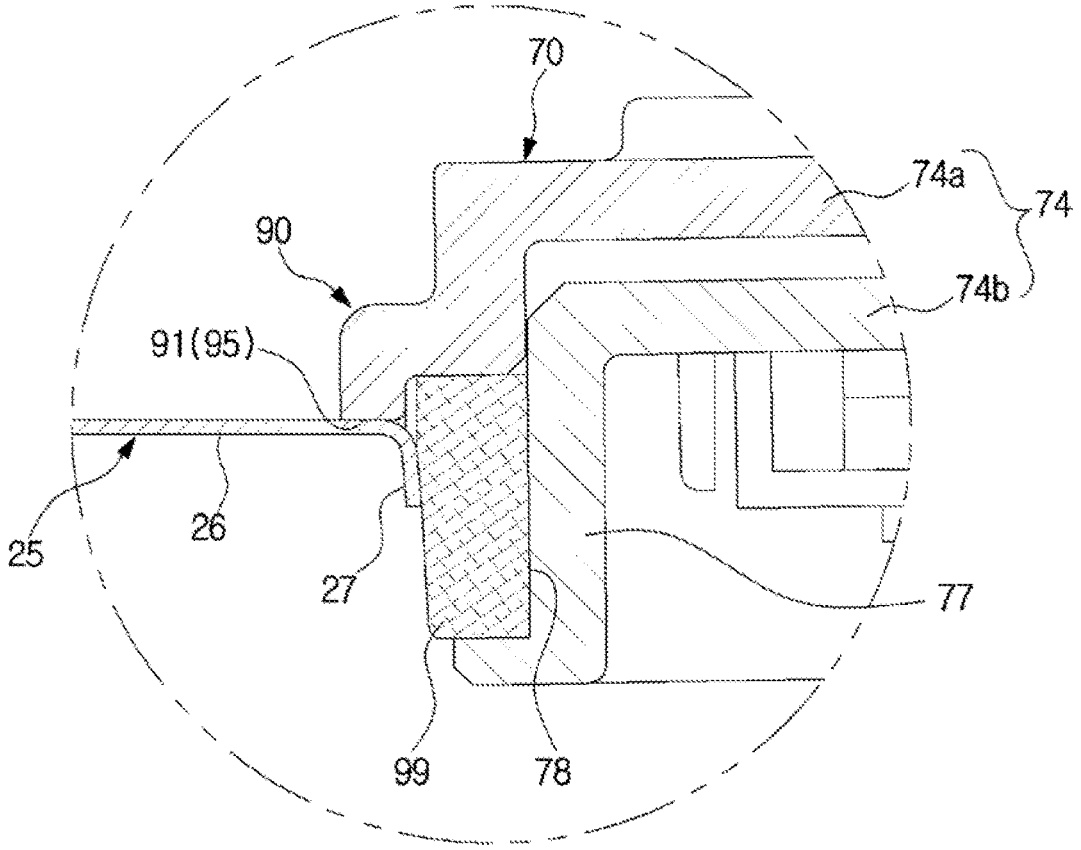
FIG. 15 is an enlarged cross-sectional view of the front end portion of the support portion shown in FIG. 12.
Figure 16:
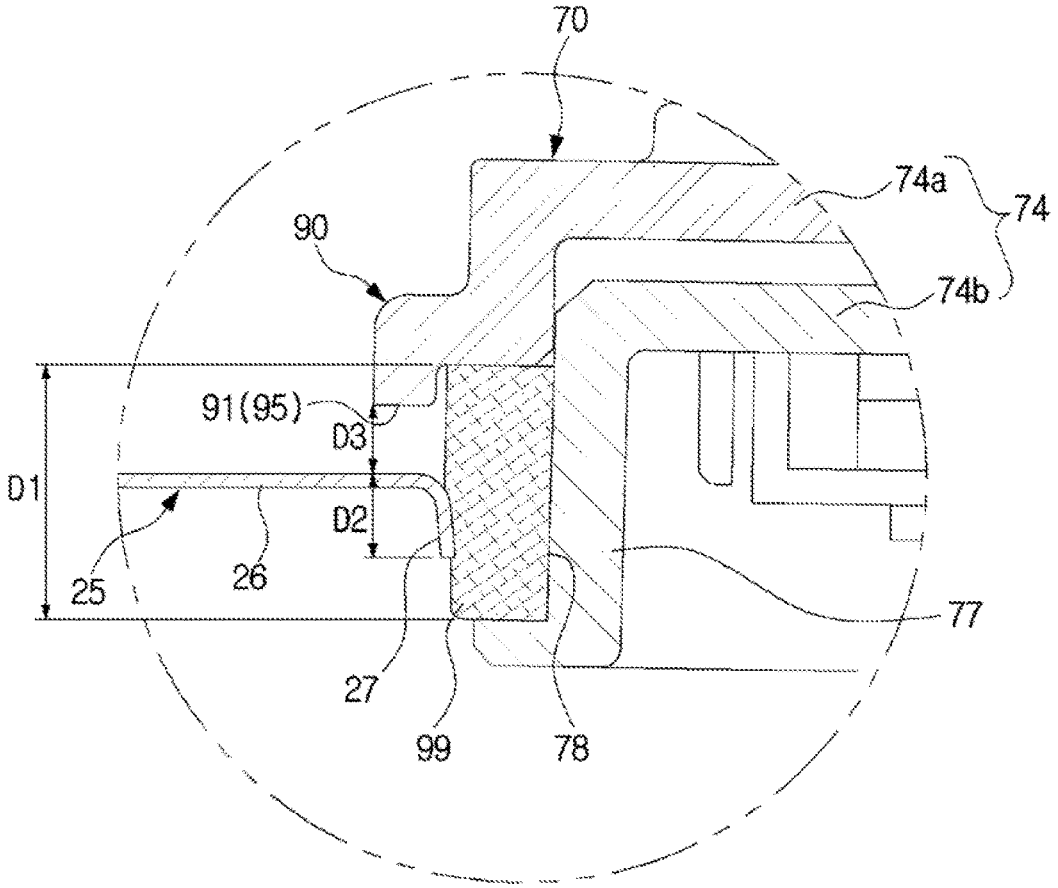
FIG. 16 is an enlarged cross-sectional view of the front end portion of the support portion shown in FIG. 13.

FIG. 7 is a side cross-sectional view showing a coupling structure of the rail and the nozzle of the dish washer of FIG. 1. FIG. 8 is an exploded perspective view showing the nozzle, a sealing member, and the bottom plate of the dishwasher shown in FIG. 1. FIG. 9 is a perspective partially cross-sectional view showing a structure of a support portion of the dishwasher of FIG. 1. FIG. 10 is a side view showing a structure in which a part of the support portion of the dishwasher of FIG. 1 is in contact with the base portion and the other part of the support portion is spaced apart from the base portion. FIG. 11 is a view schematically showing an inclined structure of the bottom surface of the support portion of the dishwasher of FIG. 1. FIG. 12 is a side view showing a positional relationship between the support portion and the base portion in the case where the base portion of the dishwasher of FIG. 1 is inclined downward from the front to the rear. FIG. 13 is a side view showing a positional relationship between the support portion and the base portion in the case where the base portion of the dishwasher of FIG. 1 is inclined upward from the front to the rear. FIG. 14 is an enlarged cross-sectional view of a front end portion of the support portion shown in FIG. 11. FIG. 15 is an enlarged cross-sectional view of the front end portion of the support portion shown in FIG. 12. FIG. 16 is an enlarged cross-sectional view of the front end portion of the support portion shown in FIG. 13.

A structure for mounting the nozzle 70 on the base portion 26 while compensating for the inclination of the base portion 26 will be described with reference to FIGS. 7 to 16, below.

When the nozzle 70 is installed on the base portion 26 under the condition that the rear end of the rail 40 is coupled with the nozzle 70 and the front end portion of the rail 40 is installed on the bottom plate 25, the bottom plate 25, i.e., the base portion 26, on which the nozzle 70 is installed may be in an inclined state. In this case, a coupling force between the rear end of the rail 40 and the nozzle 70 may be reduced, or a coupling portion between the front end of the rail 40 and the bottom plate 25 may shake so that the spraying angle of the nozzle 70 with respect to the rail 40 may change.

Therefore, the assembly structure of the nozzle 70 according to the embodiment of the present disclosure may compensate for the inclination of the base portion 26, thereby preventing the spraying angle of the nozzle 70 with respect to the rail 40 from changing even when the base portion 26 is in an inclined state.

The bottom plate 25 may include a protruding portion 27 extending downward from the base portion 26 to form an opening 28. The protruding portion 27 may be formed through a burring process or the like. In the current embodiment, the opening 28 may be in the shape of a circle, however, the shape of the opening 28 is not limited to this.

The nozzle 70 may include a support portion 90 supported on the base portion 26. The support portion 90 may extend along the rim of the opening 28 around the opening 28. The support portion 90 may extend continuously along the rim of the opening 28. In the current embodiment, since the opening 28 is in the shape of a circle, the support portion 90 may also be in the shape of a ring accordingly.

The lower surface 91 of the support portion 90 may be inclined. More specifically, the lower surface 91 of the support portion 90 may have a hinge portion 92 protruding to the downmost position, a front inclined portion 93 extending in the front direction from the hinge portion 92, and a rear inclined portion 94 extending in the rear direction from the hinge portion 92.

The hinge portion 92 may be formed at a middle point between the front end 95 of the lower surface 91 of the support portion 90 and the rear end 96 of the lower surface 91 of the support portion 90, when the nozzle 70 is viewed from the side.

The front inclined portion 93 may be formed between the front end 95 of the lower surface 91 of the support portion 90 and the hinge portion 92, and the rear inclined portion 94 may be formed between the hinge portion 92 and the rear end 96 of the lower surface 91 of the support portion 90.

As shown in FIG. 10, the front end 95 of the lower surface 91 of the support portion 90 and the hinge portion 92 may have a predetermined height difference G1, and the hinge portion 92 and the rear end 96 of the lower surface 91 of the support portion 90 may also have a predetermined height difference G2.

As shown in FIG. 11, when the nozzle 70 is viewed from the side, a straight line L1 connecting the front end 95 of the lower surface 91 of the support portion 90 to the hinge portion 92 may extend upward in the front direction, and a straight line L2 connecting the hinge portion 92 to the rear end 96 of the lower surface 91 of the support portion 90 may extend upward in the rear direction. Therefore, an angle θ formed between the straight line L1 and the straight line L2 may be smaller than 180 degrees.

Also, a plurality of hinge portions 92 may be formed in the left and right areas of the support portion 90 in such a way to be symmetrical with each other.

With the configuration, a part of the support portion 90 may be in contact with the base portion 26, and the other part of the support portion 90 may be spaced apart from the base portion 26, according to the inclination of the base portion 26.

More specifically, as shown in FIGS. 10 and 14, if the base portion 26 is not inclined, the hinge portion 92 may contact the base portion 26, whereas the front inclined portion 93 and the rear inclination portion 94 may be spaced apart from the base portion 26.

As shown in FIGS. 12 and 15, if the base portion 26 is inclined downward from the front to the rear, the hinge portion 92 and the front inclination portion 93 may contact the base portion 26, and the rear inclined portion 94 may be spaced apart from the base portion 26.

As shown in FIGS. 13 and 16, if the base portion 26 is inclined upward from the front to the rear, the hinge portion 92 and the rear inclination portion 94 may contact the base portion 26, and the front inclined portion 93 may be spaced apart from the base portion 26.

As such, since a part of the support portion 90 contacts the base portion 26 and the other part of the support portion 90 is spaced apart from the base portion 26 according to the inclination of the base portion 26, the inclination of the base portion 26 can be compensated so that an angle formed between the rail 40 and the nozzle 70 can be maintained constant without any variation.

The dishwasher 1 may include a sealing member 99 for sealing the opening 28. The sealing member 99 according to the current embodiment of the present disclosure may be disposed between the protruding portion 27 and the nozzle side portion 77 so that a gap can be made between the support portion 90 and the base portion 26 according to the inclination of the base portion 26.

The nozzle side portion 77 may be formed in the nozzle body 74 so as to face the protruding portion 27 at a predetermined distance from the protruding portion 27. A sealing member mounting portion 78 for mounting the sealing member 99 may be formed on the nozzle side portion 77. The sealing member mounting portion 78 may be in the shape of a recessed groove so that the sealing member 99 can be press-fitted into the sealing member mounting portion 78. The sealing member mounting portion 78 may be formed by a nozzle body upper plate 74*a* and a nozzle body lower plate 74*b*.

The sealing member 99 may have an annular shape having a rectangular cross section of a predetermined width and a predetermined thickness. However, the shape of the sealing member 99 is not limited, and the sealing member 99 may have a polygonal cross section. The sealing member 99 may be formed of a material having an elastic force such as a rubber material.

A thickness D1 of the sealing member 99 may be equal to or greater than a sum of a thickness D2 of the protruding portion 27 and a maximum allowable gap D3 between the support portion 90 and the base portion 26, so that the sealing member 99 can seal the opening 28 even if a relative height of the nozzle 70 with respect to the base portion 26 changes.

Figure 17:
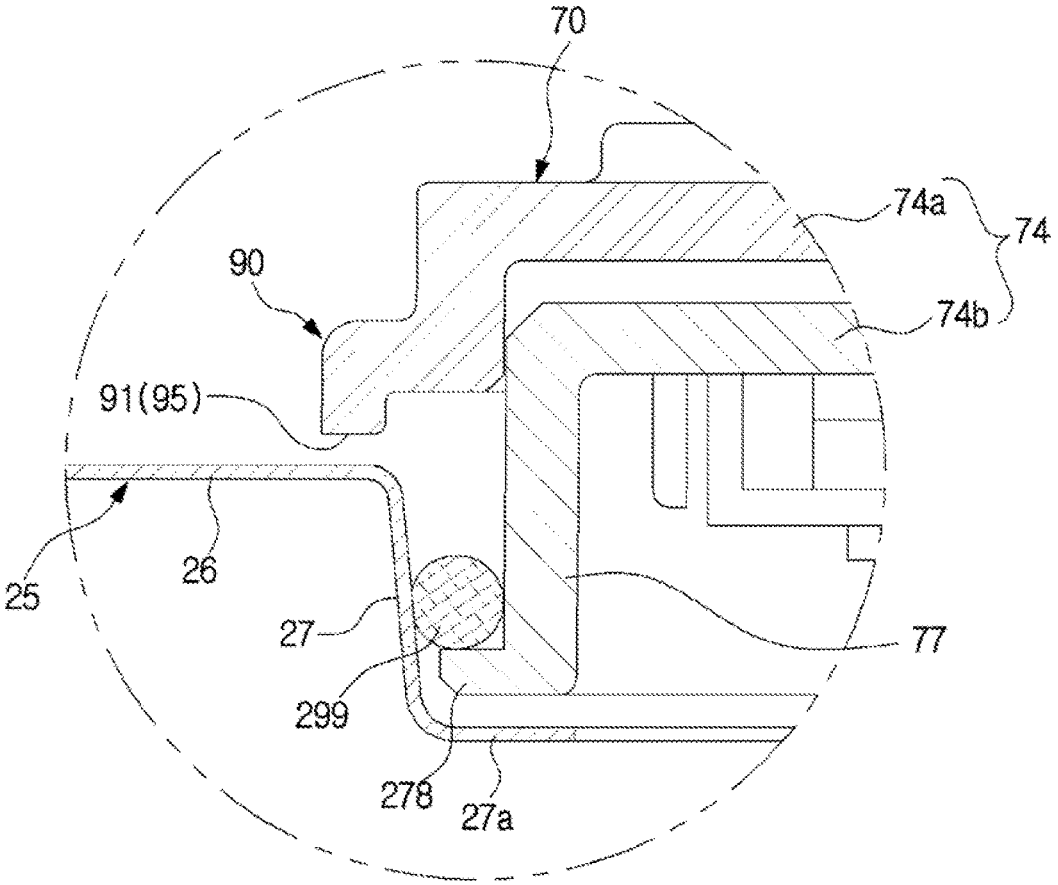
FIG. 17 to FIG. 19 show a sealing structure of a dishwasher according to another embodiment of the present disclosure.
Figure 18:
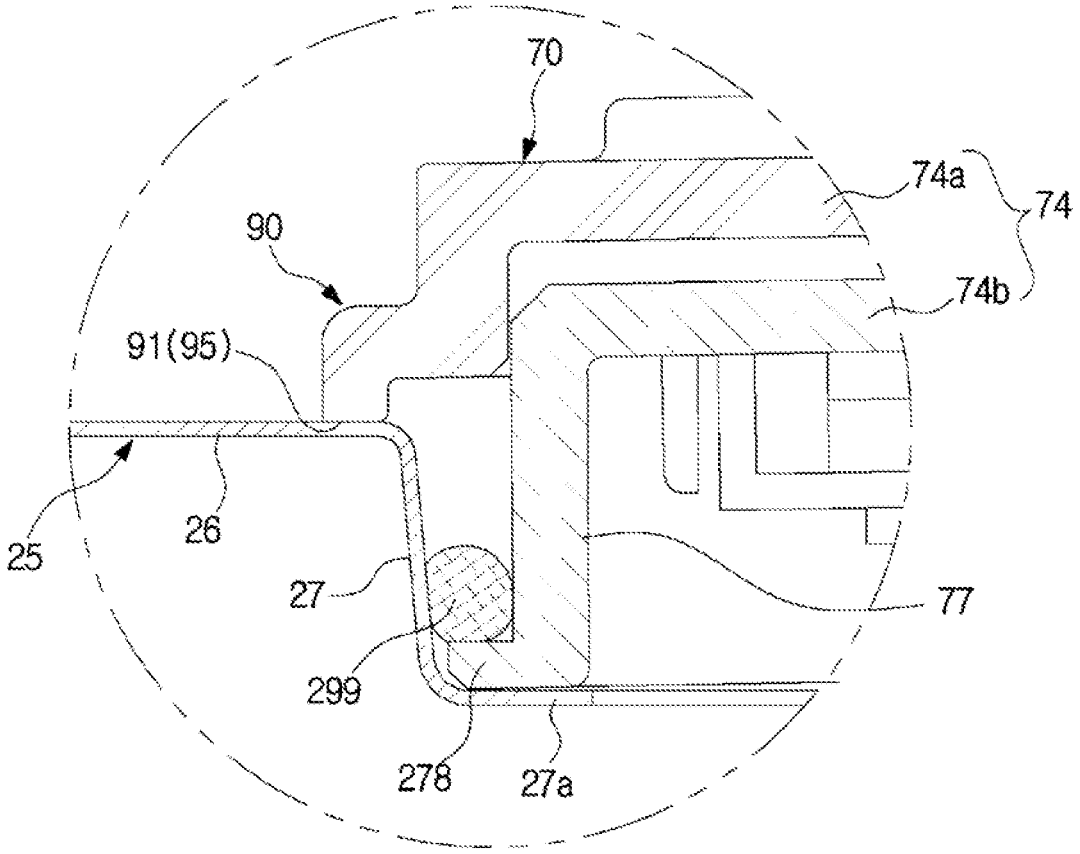
Figure 19:
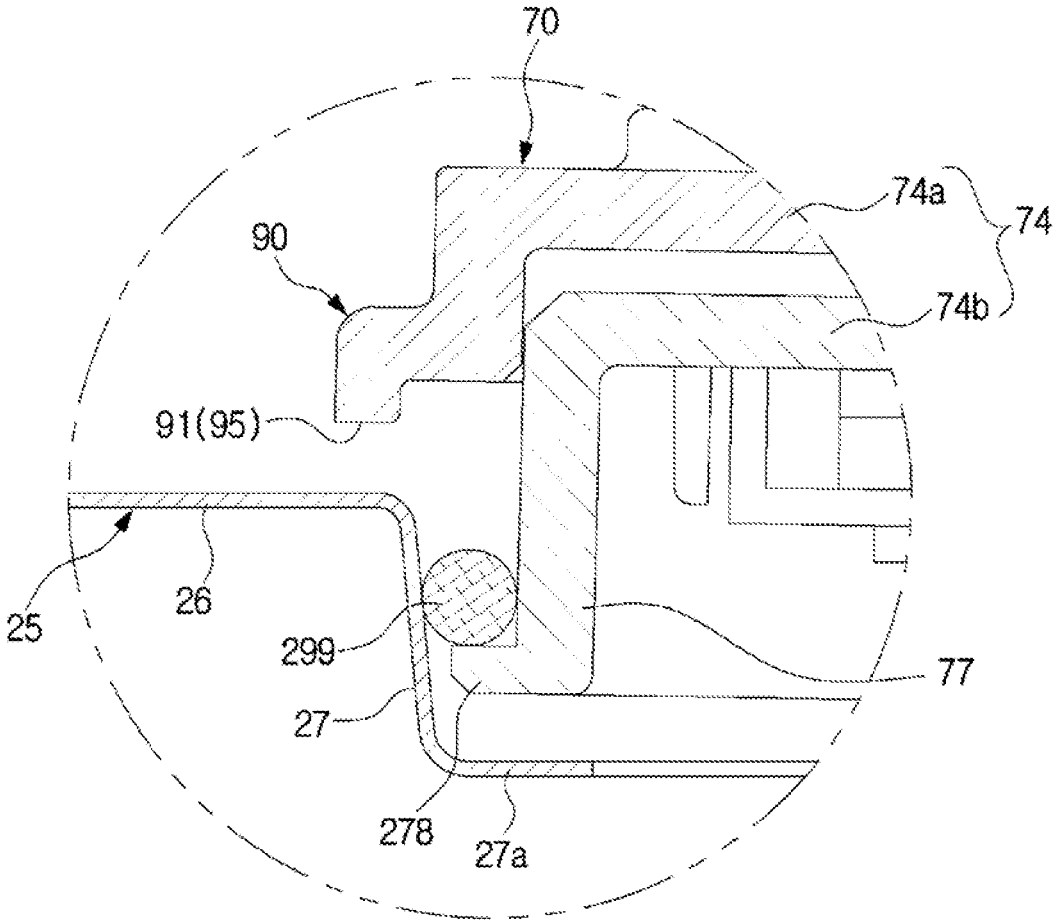

FIG. 17 to FIG. 19 show a sealing structure of a dishwasher according to another embodiment of the present disclosure. FIGS. 17 to 19 illustrate the sealing structure of the dishwasher according to another embodiment of the present disclosure, in correspondence to FIGS. 14 to 16, respectively.

If the thickness of the protruding portion 27 extending downward from the base portion 26 is sufficiently large, and the bottom plate 25 includes a bent portion 27*a* extending from the protruding portion 27, unlike the above-described embodiment, an O-ring having a circular cross section may be used as the sealing member 299.

The nozzle 70 may include a nozzle side portion 77 spaced apart from the protruding portion 27 by a predetermined distance so as to face the protruding portion 27. In the nozzle side portion 77, a sealing member mounting portion 278 on which a sealing member 299 is mounted may be formed.

According to the technical idea of the present disclosure, the spraying angle of the fixed nozzle with respect to the rail can be maintained constant even if the bottom plate on which the nozzle is installed is in an inclined state.

According to the technical idea of the present disclosure, it is possible to stably seal the opening of the bottom plate on which the nozzle is installed while maintaining a constant spraying angle of the fixed nozzle with respect to the rail even if the bottom plate on which the nozzle is installed is in an inclined state.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A dishwasher comprising:

a washing tub including a bottom plate, the bottom plate including an opening, a base portion, and a protruding portion extending downward from the base portion to form the opening;

a nozzle installed on the base portion and passing through the opening, the nozzle including a support portion supported on the base portion, a nozzle side portion facing the protruding portion, and a spraying hole configured to spray water, the support portion supported on the base portion such that a lower surface of the support portion is in contact with the base portion and at least one of a first end and a second end of the lower surface of the support portion is configured to be spaced apart from the base portion according to an inclination of the base portion;

a sealing member disposed between the protruding portion and the nozzle side portion to seal the opening;

a reflecting plate configured to reflect the water sprayed from the nozzle; and a rail configured to guide movement of the reflecting plate, wherein the nozzle includes a seating plane and the rail includes a reference plane supported on the seating plane to align the nozzle and the rail.

2. The dishwasher according to claim 1, wherein the support portion extends along a rim of the opening around the opening.

3. The dishwasher according to claim 1, wherein the lower surface of the support portion is inclined.

4. The dishwasher according to claim 1, wherein the lower surface of the support portion comprises:

a hinge portion protruding to a downmost position;

the first end extending in a front direction from the hinge portion; and the second end extending in a rear direction from the hinge portion.

5. The dishwasher according to claim 4, wherein at a position of the base portion that is not inclined, the hinge portion contacts the base portion, and the first end and the second end are spaced apart from the base portion.

6. The dishwasher according to claim 4, wherein the base portion is inclined downward, the first end contacts the base portion, and the second end is spaced apart from the base portion.

7. The dishwasher according to claim 4, wherein the base portion is inclined upward, the second end contacts the base portion, and the first end is spaced apart from the base portion.

8. The dishwasher according to claim 4, wherein a plurality of hinge portions are formed in left and right areas of the support portion in such a way to be symmetrical to each other.

9. The dishwasher according to claim 1, wherein the nozzle includes a sealing member mounting portion formed on the nozzle side portion and configured to mount the sealing member thereon.

10. The dishwasher according to claim 1, wherein a thickness of the sealing member is equal to or greater than a sum of a thickness of the protruding portion and a maximum allowable gap between the support portion and the base portion.

11. The dishwasher according to claim 1, wherein the sealing member includes an O-ring having a circular cross section.

12. The dishwasher according to claim 1, wherein the seating plane is in close contact with the reference plane, and wherein the rail is coupled with the nozzle such that the reference plane is in close contact with the seating plane.

13. A dishwasher comprising:

a washing tub including a bottom plate, the bottom plate including a base portion;

a nozzle installed on the base portion, the nozzle including a support portion configured to support the nozzle on the base portion while compensating for an inclination of the base portion, and a spraying hole configured to spray water, the support portion being in contact with the base portion such that a lower surface of the support portion contacts the base portion and a first end and a second end of the lower surface of the support portion are configured to be spaced apart from the base portion according to an inclination of the base portion, the lower surface of the support portion comprises:

a hinge portion protruding to a downmost position;

the first end extending in a front direction from the hinge portion; and the second end extending in a rear direction from the hinge portion;

a reflecting plate configured to reflect the water sprayed from the nozzle; and a rail configured to guide a movement of the reflecting plate, wherein the nozzle includes a seating plane and the rail includes a reference plane supported on the seating plane to align the nozzle and the rail.

14. The dishwasher according to claim 13, wherein an opening is formed in the bottom plate, and wherein the nozzle passes through the opening.

15. The dishwasher according to claim 14, further comprising a sealing member configured to seal the opening.

16. The dishwasher according to claim 15, wherein the bottom plate includes a protruding portion extending downward from the base portion to form the opening, the nozzle includes a nozzle side portion facing the protruding portion, and the sealing member seals between the protruding portion and the nozzle side portion.

17. A dishwasher comprising:

a washing tub including a bottom plate, the bottom plate including a base portion;

a nozzle installed on the base portion, the nozzle including a support portion configured to support the nozzle on the base portion and a spraying hole configured to spray water, the support portion being in contact with the base portion such that a lower surface of the support portion contacts the base portion and at least one of a first end and a second end of the lower surface of the support portion is configured to be spaced apart from the base portion according to an inclination of the base portion;

a reflecting plate configured to reflect the water sprayed from the nozzle; and a rail configured to guide a movement of the reflecting plate, wherein the nozzle includes a seating plane and the rail includes a reference plane supported on the seating plane to align the nozzle and the rail.

18. The dishwasher according to claim 17, wherein the seating plane is in close contact with the reference plane, and the rail is coupled with the nozzle such that the reference plane is in close contact with the seating plane.

* * * * *